US012492494B2

(12) United States Patent
Soylu

(10) Patent No.: US 12,492,494 B2
(45) Date of Patent: Dec. 9, 2025

(54) OBTAINING WARP KNIT FABRICS FROM COTTON YARN WITH WARP KNITTING MACHINES

(71) Applicant: VERITAS TEKSTIL KONFEKSIYON PAZARLAMA SANAYI VE TICARET ANONIM SIRKETI, Denizli (AR)

(72) Inventor: Mustafa Soylu, Denizli (AR)

( * ) Notice: Subject to any disclaimer, the term of this patent is extended or adjusted under 35 U.S.C. 154(b) by 0 days.

(21) Appl. No.: 18/617,012

(22) Filed: Mar. 26, 2024

(65) Prior Publication Data

US 2024/0344250 A1 Oct. 17, 2024

Related U.S. Application Data

(63) Continuation-in-part of application No. 16/482,815, filed as application No. PCT/TR2018/050309 on Jun. 13, 2018, now abandoned.

(30) Foreign Application Priority Data

Dec. 19, 2017 (TR) ..... 2017/20766

(51) Int. Cl.

| | |
|---|---|
| ***D04B 21/04*** | (2006.01) |
| ***D04B 21/02*** | (2006.01) |
| ***D06M 13/188*** | (2006.01) |
| ***D06M 101/06*** | (2006.01) |

(52) U.S. Cl.

CPC ..... *D04B 21/04* (2013.01); *D04B 21/02* (2013.01); *D06M 13/188* (2013.01); *D06M 2101/06* (2013.01); *D10B 2201/02* (2013.01)

(58) Field of Classification Search

CPC ..... D04B 21/02; D04B 21/04; D04B 21/14; D04B 21/16; D10B 2403/021

See application file for complete search history.

(56) References Cited

U.S. PATENT DOCUMENTS

| | | | | |
|---|---|---|---|---|
| 7,520,121 | B2 * | 4/2009 | Teshima | D02G 3/32 57/236 |
| 2004/0131821 | A1 * | 7/2004 | Mandawewala | D02G 3/406 57/238 |
| 2009/0317584 | A1 * | 12/2009 | Ivanoff | D03D 15/37 428/95 |
| 2013/0037163 | A1 * | 2/2013 | Teshima | D03D 15/49 139/420 R |
| 2019/0309452 | A1 * | 10/2019 | Liao | D04B 1/18 |

FOREIGN PATENT DOCUMENTS

CN 1779012 A * 5/2006

* cited by examiner

*Primary Examiner* — Aiying Zhao

(74) *Attorney, Agent, or Firm* — Egbert, McDaniel & Swartz, PLLC

(57) ABSTRACT

A method for producing a warp knit fabric from cotton yarns includes forming a warp yarn by using 80/2 Ne cotton yarn obtained by twisting 80/1 Ne cotton yarns, forming a pile yarn by twisting a polyvinyl alcohol yarn and a cotton yarn, forming a ground yarn by using twisting double ply twisted cotton yarns, knitting the warp yarn and the pile yarn and the ground yarn in a warp knitting machine, treating the warp knit fabric with an acid at 90° C. for twenty minutes, and removing the polyvinyl alcohol yarn from the treated warp knit fabric such that the warp knit fabric is 100% cotton.

4 Claims, 11 Drawing Sheets

OBTAINING WARP KNIT FABRICS FROM COTTON YARN WITH WARP KNITTING MACHINES

CROSS-REFERENCE TO RELATED APPLICATIONS

The present application is a continuation-in-part of U.S. application Ser. No. 16/482,815, filed on Aug. 1, 2019, now abandoned.

BACKGROUND OF THE INVENTION

The invention relates to a method for obtaining warp knit fabrics (spacer fabrics) made of 100% cotton yarn with warp knitting machines.

The invention in particular relates to a method for obtaining terry or non-terry warp knit fabric (spacer fabric) with or without pile from 100% cotton yarns with increased elasticity and tensile strength due to modified torsion and twisting values, using warp knitting machines, intended to be used in the design of different constructions.

Forming loops from threads and tying these loops together is called knitting, and fabrics obtained by tying the obtained loop to other previously formed loops by means of special tools such as knitting needles, crochet hooks, needles are called knit fabrics or tricots. These fabrics have a widespread area of use such as medicine, construction, sports, packaging, automotive, military, clothing etc. Systems where the thread forms loops along the width of the fabric are called weft knitting systems. System with loops formed along the length of the fabric are called warp knitting systems. While the fabric is formed by connecting a thread to itself over and over again in weft knitting system, it is formed by connecting a series of threads to each other in the warp knitting system (along the warp direction).

In the warp knitting technique, which is the fastest fabric manufacturing technique, threads which are going to form the fabric are wound on warp beams and delivered all together to the knitting area, as in the case of weaving machines. Each needle receives at least one thread and all of the needles are raised up all together at the same time in order to form the loop. Loops are formed at each horizontal and vertical row. All needles move together along needle rails together in warp knitting machines.

Warp knit fabrics in general can be distinguished by a vertical thread flow. Meanwhile, threads are usually fed by warp beams and/or coil hangers. With a wide area of applications, it is possible to implement a large number of applications which differ from each other in terms of pattern, number and required knitting members and thread feeding systems, using a variety of different machines.

Warp knit fabrics are manufactured by feeding the knitting needles with threads wound off from a warp beam in order to be put through needles with holes and to form loops. They are fabrics exhibiting similar features to woven fabrics in terms of dimensional stability. Warp knit fabrics are more stable with respect to weft knit fabrics and their loops are less apparent. Elasticity of warp knit fabrics is lower. Warp knit fabrics can be distinguished from weft knit fabrics by a careful inspection of their face and back. The face of the fabric is composed of fairly clear, apparent face loops, where the loops are arranged vertically and at a slight angle form one side to the other. The back of the fabric has slightly inclined horizontal lines. These lines are called threads from above and from below and formed by the lateral motion of the warp threads that form the fabric. Identifying these threads is the most important distinction that the warp knitting possesses, while the most distinguishing feature is being resistant to unraveling.

The knitting surface is formed by establishing connected loops through following lengthwise and lateral zigzag patterns. This feature makes it harder for the texture to unravel and the loop to run in the warp knitting. Furthermore, elasticity of knitting is very low.

Loops used in warp knitting are formed in two different ways in terms of the structure of the bottom loop and the appearance in the structure. This is called open loop and closed loop. A cross bottom loop is the most important feature of the closed loop, while not having a cross bottom loop is the important feature of the open loop.

Warp knitting machines are classified under two groups named tricot (warp apparatus) and raschel. In past, bearded needles were used in tricot machines, while latch needles were used in raschel machines. It was possible identify if it was a tricot or a raschel machine based on the needle type. Today, both needles have been replaced by combined needles (sliding needles). In order to identify the machine at which the fabric is produced, used plating and the role of the plating in loop formation plays an important role.

Texturing is formed by putting the weaving layout, i.e. the warp threads coming from the beams, through the inlay needles with holes, by means of the lateral motion of the inlay rails in front of and behind the knitting needles.

Bearded needles are used in straight warp knitting machines where RL-bearded needles having two perpendicular bearings are used, and the lower needle bearing only performs oscillating motion while the upper needle bearing performs both oscillation and forward-backward motion. Moreover, thread guides are also available in the machine in order to aid the knitting.

Tongue needles are used in straight warp knitting machines where RL-tongue needles having two perpendicular bearings are used, and the lower needle bearing performs forward-backward motion while the upper needle bearing performs oscillation and forward-backward motion. Again, thread guides are also available in the machine in order to aid the knitting.

Latch needles are used in straight warp knitting machines where RL-latch needles having two perpendicular bearings are used, and the lower needle bearing only performs forward-backward motion, while the upper needle bearing performs both oscillation and forward-backward motion. Thread guides are also available in the machine in order to aid the knitting.

Bearded needles are used in RL-monorail straight warp knitting machines (Milano type) having two perpendicular bearings, and while the lower needle bearing only performs forward-backward motion, the upper needle bearing performs both oscillation and forward-backward motion, in addition to a motion similar to rotation. Again, thread guides are also available in the machine in order to aid the knitting.

RL-monorail straight warp knitting machine (Scope type): have bearded needles used in a simple machine where a single, horizontal needle bearing is present, and needles perform forward-backward motion inside the needle bearing.

Straight warp knitting machine use a RR-tongue needle (Raschel type). In these more complicated knitting machines, tongue needles move inside a larger number of needle bearings, which allow a greater freedom of motion. Lower bearings are positioned at angle with respect to each other, instead of being straight. Similarly, the number of used thread guides are also increased.

In RR-straight warp knitting machines (Simplex type), both the lower and the upper bearings are introduced at a certain angle with respect to each other. The upper bearings perform oscillations and forward-backward motion, while the lower bearings perform forward-backward motion. Bearded needles are used and thread guides are available.

Sandwich textiles are three dimensional textile structures comprising two outer surfaces and a binding layer which binds these two outer surfaces. Sandwich textiles possess specific features due to their special structures, which cannot be achieved by conventional textile structures. Even though sandwich textiles are fairly new in terms of technology, the demand towards special textile structures has increased the attention they draw. Therefore, research and development activities regarding sandwich textiles have become more interesting in the recent years. Research on sandwich textiles allowed production of sandwich textiles with different features intended to be used in various application areas. While sandwich textiles can be manufactured using weaving, weft knitting and warp knitting techniques, the warp knitting technique is the most commonly used. Sandwich textiles allow using a variety of materials, have a flexible product range and possess three dimensional structures, which make them possible to be used in a number of different areas such as automotive textiles, geotextiles, sportswear, underwear and outerwear, protective textiles and composites.

Warp knitting technology is the most commonly used technology for manufacturing sandwich textiles (spacer fabric) and the sandwich textiles manufactured using warp knitting techniques have a much wider range in terms of physical and physiological features, in comparison to classical woven or knit fabrics.

Warp knit sandwich textiles are produced using Raschel machines with double needle rails, based on the principle of manufacturing two separate fabrics on two needle rails of the machine and binding these two fabrics by means of suitable binging threads. Manufacturing of fabric surfaces is carried out on the front and back needle rails of the machine. The construction of the main surfaces are selected based on the features expected from the end product and realized through a combination of inlaying and drafting processes.

There are four inlay rails in double needle rail Raschel machines used in warp knit sandwich textile production. The first and fourth inlay rails are used for production of the outer surfaces of the sandwich textile and drafted based on the desired outer surface pattern. In FIG. 2, a schematic representation is shown of the warp knit sandwich textile manufacturing principle in double needle rail Raschel machines (20).

By using a different draft at each inlay rail, different surface constructions can be achieved. First inlay rail inlays are used for only the first needle rail and the fourth inlay rail inlays are used for only the second needle rail, while the second and third inlay rails inlay are used for both needle rails. By means of the inlaying for both of the needle rails by the second and the third inlay rails, binding threads bind two main fabric surfaces. Depending on the product features and the requests expected from the demanded product, a minimum of four inlay rails are used. In general, however, 5 to 7 inlay rails are used.

In double needle inlay rail Raschel machines, sandwich textiles with thickness varying between 1.5 mm and 160 mm can be produced. The thickness of the sandwich textile is set by adjusting the distance between two needle rails depending on the desired sandwich textile thickness. Sandwich textiles up to 20 mm thickness can be manufactured in Raschel machines without requiring any modification. On the other hand, for the production of sandwich textiles having more than 20 mm thickness and called "High Distance (Very Thick) warp knit sandwich textiles", modifications in Raschel machines are necessary. Furthermore, it is also possible with Raschel machines to manufacture sandwich textiles shaped on the machine depending on the end product.

Sandwich textiles provide physiological comfort due to providing a combination of air, humidity and heat transport and permeability properties. Furthermore, compressibility strength additionally improves this characteristic. All these features provide a microclimate effect to sandwich textiles. Therefore, these features allow sandwich textiles to be used in sportswear, mattresses and medical industries.

While in simple knitting cycles, needle rods run independently during upward and downward motion, guiding rods oscillate alternatingly between needles of each rod.

The thread introduced along the rod inside the knit structure is called "warp inlaying". It is not possible to establish warp inlaying in current weft knitting machines, without making any modifications.

A large number of needles are used during warp knitting and all needles perform the same motion at the same time. In order to obtain a loop form, each warp line should feed a needle. Needles used in warp knitting machines are in general arranged on a needle rail in a straight line.

Each warp thread is put through the hole of a reed needle. Reed needles with holes are lined up on a inlay rail (reed). Due to the motion of the reed, warp threads are entangled to the needles. Motion of the needle rail leads the warp threads to simultaneously form loop forms.

The reed performs the motion called inlaying. Because with this inlaying, each reed needle with the hole (along with the warp thread), performs a lateral motion (jump) behind the needle (lower inlaying). Thereafter, reed needles with holes perform oscillation in between two needles towards the inside. With the lateral motion, the warp threads are inlaid to the stems of the needles and the reed needles passing in between two neighbor needles perform oscillation towards the outside thus completing the motion set. Following the oscillation towards outside, threads are inlaid on the needle hooks with the descending motion of the needles. These threads move through the available loops resulting in a new row of loops.

Knitting elements and the thread geometry (thread angle) of tricot machines are different from that of other machines. A plating rail moves along forward-backward direction horizontally. The needle rail moves along an up-down direction along with the latch needles. The same motion is also independently performed by the needle latch rail. The inlay rail, where the reed needle with hole is located, also performs motion along the forward-backward and left-right directions depending on the pattern.

The knitting elements are positioned at about a 90 degree angle. Therefore, when the thread geometry is investigated, it can be seen that the combined force on the needle is high.

In the beginning of knit formation, the latch needle is at the bottommost position and a loop is present at the head portion of the needle. The reed, and each reed needle with hole along with it, perform lower inlaying. Meanwhile, the plating rail continues its forward motion and consequently pushes forward and grabs the loop at the head of the needle and the fabric behind it.

The latch needle (except the latch) starts an ascending motion and meanwhile, the knit loop (since it is connected to the readily knit fabric) is maintained under tension. Thereby the fabric is prevented for ascending with the needle, while, on the other hand, the needle stem is sliding. Meanwhile, the inlay rail completes the lower inlaying motion.

The latch needle ascends to the uppermost position. The latch also ascends but not as much to close the hook of the needle. The reed passes between two latch needles by performing oscillation towards inside and reaches the gap between two needles.

The reed needle with the hole performs upper inlaying to the stem of the latch needle. The inlay needle passes between needles by oscillating towards the outside while at the same time the a new loop is placed at the head portion of the latch needle under compression.

While the needle and its latch are performing a descending motion at different speeds (the needle is fast, the latch is slow), the head of the needle closes. At the same time, the tension on the needle weakens. Therefore, the loop is able to slide on the latch towards the needle stem (casting loop). Meanwhile, the reed needles with holes starts a new lower inlaying. While the latch needle is continuing the descending motion, the needle, at the loop casting edge on the plating, it passes the thread which is inlaid through the needle stem through the previous loop in order to create new knot. Therefore, the newly fed thread becomes a loop. The plating rail then starts repeating the fabric grabbing process.

In warp knitting, Raschel type machines can be adjusted as in the manner of single sided knitting and double-sided knitting machines. The rail needle (equipped with latch needles) ascends along the vertical direction and descends. The same motion is also performed by the latch of the needle. The loop reed rail performs forward-backward motion along the horizontal direction. The loop casting rail is fixed. The inlay rail where the reed needles with holes are present also performs forward-backward motion and lateral motion along the horizontal direction.

Layout of the knitting elements results in a 170° angle between the incoming warp thread and the fabric. Depending on the thread geometry, the combination of the forces acting upon the needle is low, despite the high thread tension.

In all of warp knitting machines, wefts are positioned by means of a weft reserving device. In this method, threads which will be used in the fabric are first stored in a reserve introduced behind the machine. This means that in order to be added into the warp knit structure, threads of required lengths should be gathered in a straight form and kept ready.

The operating principle of a weft reserve placement device is as follows: Weft threads are compressed into a carrier introduced between two rotating reserve chains. This weft compressing operation is performed independent of loop forming. Thereafter, weft threads can be fed both to the knitting elements one by one and along the same direction with loop rows. Since they are used between lower laid-ins and needle loops, a fairly uniform entanglement is achieved at the fabric surface.

Weft or laid-in is a thread length which is placed continuously on the fabric surface. The thread does not form a loop or hanger. This is because it is never inlaid to the needle head as a loop. In other words, it does not perform any upper inlaying. Instead, it is only inlaid behind the needle in the lower inlaying position.

Knit pile fabrics are knot binding fabrics comprising warp knitting, one sided thread, fiber loop or staple fiber yarn. However, pile structures may be on both sides of the structure.

In addition to pile devices, knit pile fabrics can be manufactured by different means such as pile plating reeds, pile guides or pile (pol) reeds. The pile device is frequently used in the pile plating reed of tricot machines. The pile plating is introduced on the composite plating and performs lateral motion along the horizontal direction. During the warp knitting, one or several reeds during the lower inlaying form the pile loop with the help of the pile plating. The size of the pile loop increases with the height of the pile plating. Threads on the remaining reeds form the fabric floor.

In the prior art, U.K. patent application numbered GB2339803A relates to straight weft knitting machines. In the application, weft or warp inlays are placed inside double inlaid knit structures by performing some modifications on weft straight knitting machine. For this, knitting heads are separated from each other and an endless chain mechanism is used in order to allow the knitting heads to operate in the same direction and at the same speed. Thereby, an area through which warp laid-in threads can be guided and it becomes possible to introduce guides in order to allow feeding the knitting area with warps. Warp guides are connected to each other by means of a metal plate and their positions are fixed in line at the knitting area again by the same plate. Warp guides do not move and since warp guides are positioned in the middle of the knitting are, positioning shuttles with knitting heads A shuttle (thread guide) is fixed to each knitting head and knitting heads are separated into two parts which are front and back, in order to achieve a two system machine. Thereby, while a row is being knit, the shuttle fixed on the knitting head on the front needle bearing feeds knitting thread, while in the other row, the shuttle fixed on the head on the back needle bearing feeds knitting thread. Therefore, the knitting thread passes in front of the warp laid-ins in one row, and passes behind it in the other row, in order to form the loops. Thereby a double bearing (e.g. ribana) is knit. However, a different thread is fed into each row and it becomes possible to achieve warp inlaying with the thread fed from the warp guides during knitting. No alterations on the machine have been performed on the machine except some modifications to the shuttles in order to allow weft feed during knitting. In order to ensure a proper weft laid-in thread to be fed into the knitting area, presser feet are adapted to pass it through a tube and between two bearings and into the fabric.

Due to the very high tension between the needle rail and the inlay rail in warp knitting machines, it is not possible to use 100% cotton yarns in warp knitting devices. The yarn passing through the needle rail has to be stressed during the left-right motion of the inlay rail. Since the inlay rail moves the thread with varying force and acceleration to create this motion, the yarn from the beam is exposed to breaking forces. Therefore, synthetic or synthetic blended fibers are used in these machines. It is known that the tensile strength of the 100% cotton fiber is much lower than the tensile strength of synthetic yarns.

SUMMARY OF THE INVENTION

The present invention relates to obtaining warp knit fabrics from cotton yarn using warp knitting machines which meet the aforementioned requirements, overcome all the disadvantages and provide further advantages.

The object of the invention is to increase the elasticity and tensile strength of yarn made of 100% cotton fiber by modifying torsion and yarn twisting values.

The object of the invention is to allow knitting of 100% cotton yarns with enhanced strength by twisting at different angles and twisting number, in warp knitting machines.

The object of the invention is to obtain terry or non-terry warp knit fabric with or without pile from 100% cotton yarns.

In order to achieve the aforementioned objects, the invention is a method for obtaining from cotton yarns using warp knitting machines, intended to be used in different design. This process includes the step of:

- forming a warp yarn of 100% cotton by using a 80/2 Ne cotton yarn which is obtained by twisting two 80/1 Ne cotton yarns;
- forming a pile yarn with increased strength, by twisting a polyvinyl alcohol yarn and a cotton yarn having a thickness ranging from 120/1 Ne to 0.5 Ne;
- forming a ground yarn of 100% cotton by using double ply twisted cotton yarns, which is obtained by twisting two double ply twisted yarns;
- knitting the warp yarn and the pile yarn and the ground yarn in a warp knitting machine to form a warp knit fabric; and
- treating a knitted warp knit fabric with an acid at 90° C. for twenty minutes; and
- removing a polyvinyl alcohol yarn from the this treated warp knit fabric such that the warp knit fabric is formed of 100% cotton.

In order to achieve the objects of the invention, a pile plate is added to the warp knitting machine mentioned in step c in order to obtain pile and terry warp knit fabric.

The structural and characteristic features and all of the advantages of the invention shall become apparent with the detailed description given below.

PARTS REFERENCES

Figure 1:
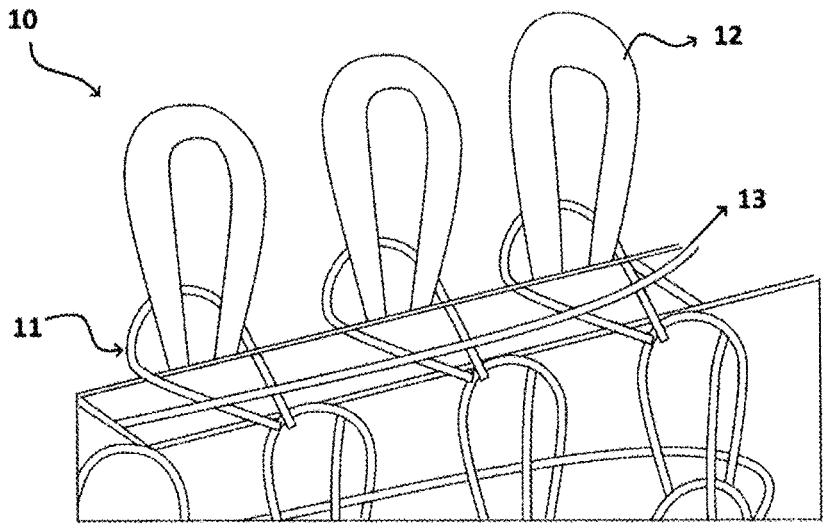
FIG. 1 is a detail view of the warp knit fabric.

10. Warp knit fabric
11. Warp yarn
12. Pile yarn
13. Ground yarn
14. Inlay rail
15. Inlay needle
16. Needle
17. Needle rail
20. Double needle railed Raschel machine
21. 1st inlay rail
22. 2nd inlay rail
23. 3rd inlay rail
24. 4th inlay rail
25. 1st needle rail
26. 2nd needle rail

DETAILED DESCRIPTION OF THE INVENTION

The method for obtaining warp knit fabric (spacer fabric) (10) from cotton yarns in warp knitting machines is disclosed herein detailed description without limiting the scope of the invention.

The invention relates to a method for obtaining terry or non-terry warp knit fabric (spacer fabric) (10) with or without pile from 100% cotton yarns with increased elasticity and tensile strength due to modified torsion and twisting values, using warp knitting machines, intended to be used in the design of different constructions. A detail view of the warp knit fabric (10) is given in FIG. 1.

Figure 2:
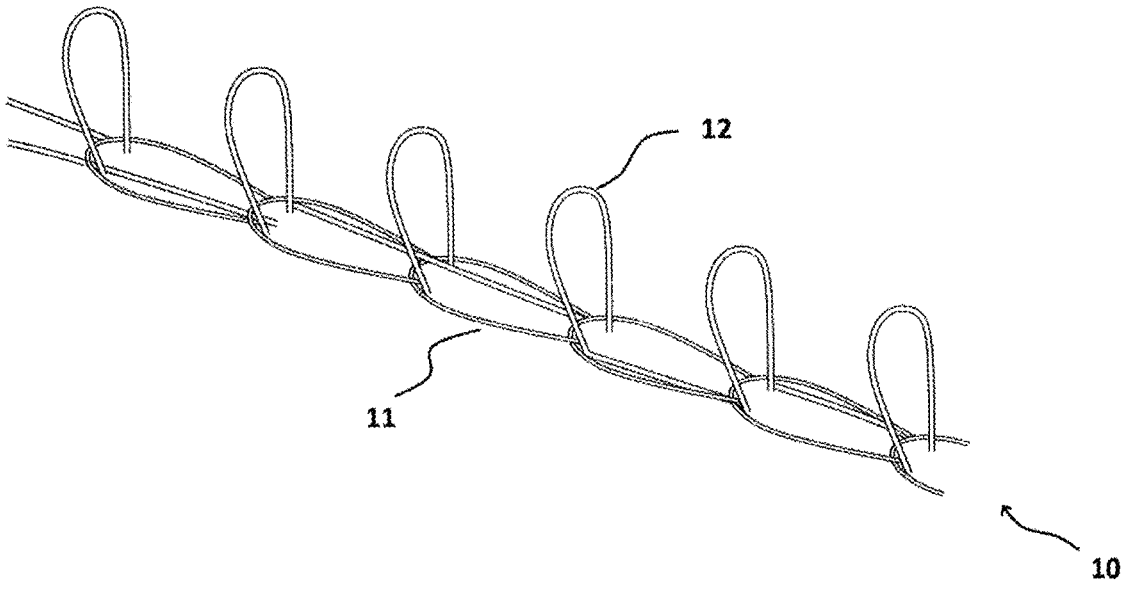
FIG. 2 is a detail view of the pile yarn and warp yarn positions in the warp knit fabric.
Figure 3:
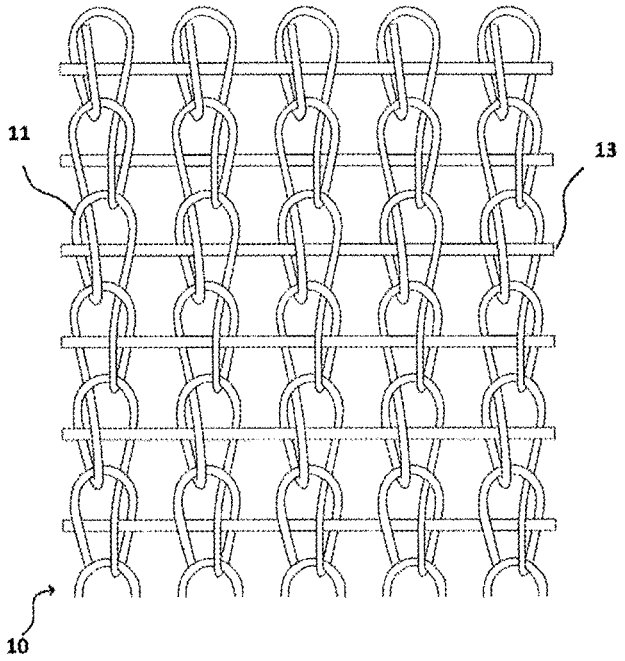
FIG. 3 is a detail view of the warp yarn and ground yarn positions in the warp knit fabric.

In knitting the warp knit fabric, 80/2 Ne combed cotton is the warp yarns (11), 100% cotton by using double ply twisted cotton yarns is the ground yarns (13), and cotton yarn twisting with a polyvinyl alcohol yarn is the pile yarns (12). FIG. 2 shows a detail view of the position of the pile yarn (12) and warp yarn (11) in the warp knit fabric (10). FIG. 3 shows a detail view of the position of the warp yarn (11) and the ground yarn (13) in the warp knit fabric (10).

While obtaining the pile yarn (12), cotton yarn is twisted in opposite direction with PVA (polyvinyl alcohol).

Figure 4:
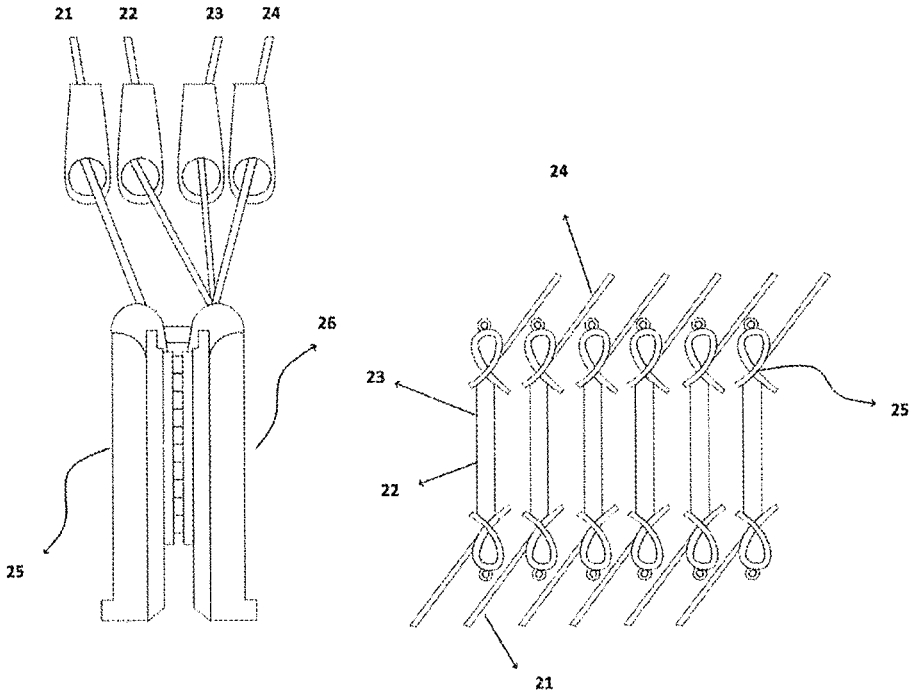
FIG. 4 is a schematic view of the manufacturing principle of the warp knit fabrics (spacer fabric) in double needle railed Raschel machines.

The warp knit fabric (10) of the invention is knitted with raw yarns and white tops dyeing is applied. During the tops dyeing process, before the bleaching process, the fabric is treated with acid at 90° C. for 20 minutes. Thereby the PVA fiber is removed from the raw product. In FIG. 4, a schematic view of the manufacturing principle of the warp knit fabrics (spacer fabric) (10) in double needle railed Raschel machines is given.

The present invention is a method of producing a warp knit fabric of 100% cotton. This method includes the steps of:

- forming a warp yarn of 100% cotton by using a 80/2 Ne cotton yarn which is obtained by twisting two 80/1 Ne cotton yarns;
- forming a pile yarn with increased strength by twisting a polyvinyl alcohol yarn and a 100% cotton yarn having a thickness ranging from 120/1 Ne to 0.5 Ne;
- forming a ground yarn of 100% cotton by using double ply twisted cotton yarns, which is obtained by twisting two double ply twisted cotton yarns;
- knitting the warp yarn and the pile yarn and the ground yarn in a warp knitting machine to form a warp knit fabric;
- treating a knitted warp knit fabric with an acid at 90° C. for twenty minutes; and
- removing a polyvinyl alcohol yarn from the threated warp knit fabric such that the warp knit fabric is formed of 100% cotton.

In an embodiment of the inventive method, the warp knitted fabric is treated with an acid, preferably acetic acid, at 90° C.

Another embodiment of the inventive method, the warp knitted fabric is treated with an acid, preferably formic acid, at 90° C.

A feature of the invention is that acetic acid or formic acid may be used as the acid during removal of the PVA yarn from the obtained fabric.

A feature of the invention is that, during the step of obtaining pile yarn (12), the tension created between the needle rail and the inlay rail is decreased using the elasticity of the PVA thread.

A feature of the invention is that, it is possible to obtain pile and terry warp knit fabrics by adding a pile plate to the warp knitting machine used in the step of knitting the warp knit fabric.

FIG. 4 shows the manufacturing principle of the warp knit fabrics (spacer fabric) in double needle. The 1st inlay rail (21) and 4th inlay rail (24) are used for the production of the outer surfaces of the sandwich textile, and the sandwich textile is knitted according to a desired outer surface pattern. Here, different surface constructions can be obtained with the use of different drawing wheels on each inlay rail. While the 1st inlay rail (21) inlays only in the 1st needle rail (25), the 4th inlay rail inlays only in the 2nd needle rail (26), the 2nd inlay rail (23) and 3rd inlay rail (24) inlays in both needle rails. With the 2nd and 3rd inlay rails (23 & 24) inlaying in both needle rails (25 & 26), the binding threads join the two basic fabric surfaces. A minimum of four inlay rails are used according to the characteristics of the product and the expected demands on the product.

Figure 5:
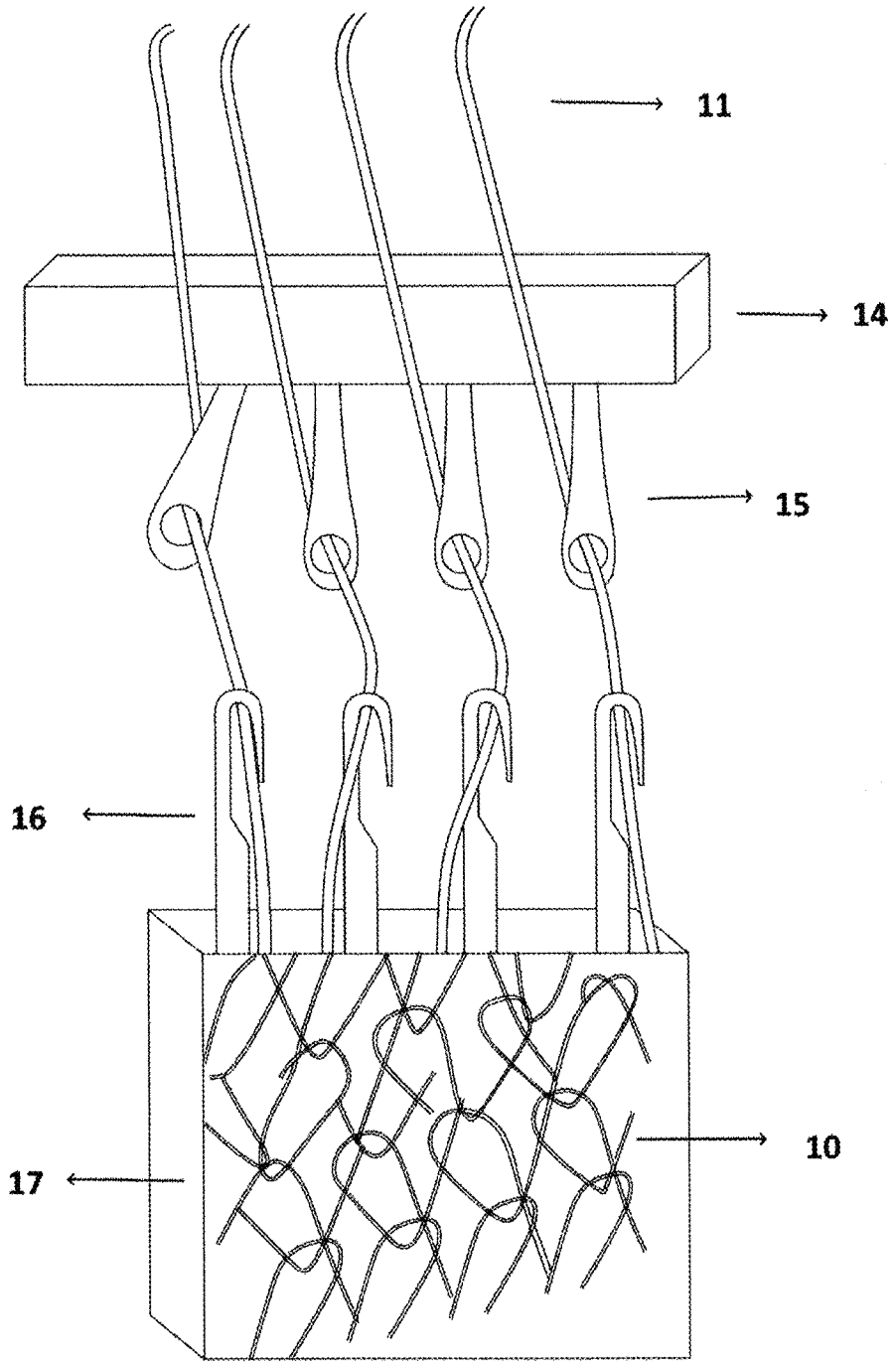
FIG. 5 is a schematic view of the principle of warp knitting.

FIG. 5 shows the principle of warp knitting. Usually, the needles (16) used in warp knitting machines are arranged in a straight line on a needle rail (17). Each warp yarn (11) is passed through a perforated inlay needle (15). The perforated inlay needles (15) are also arranged on an investment inlay rail (14). Due to the movement of the comb, the warp yarn (1) are entangled around the needles (16). the movement of the needle rail (17) results in the warp yarns (11) simultaneously forming a loop. Needle rails is called Inlay needle.

Figure 5A:
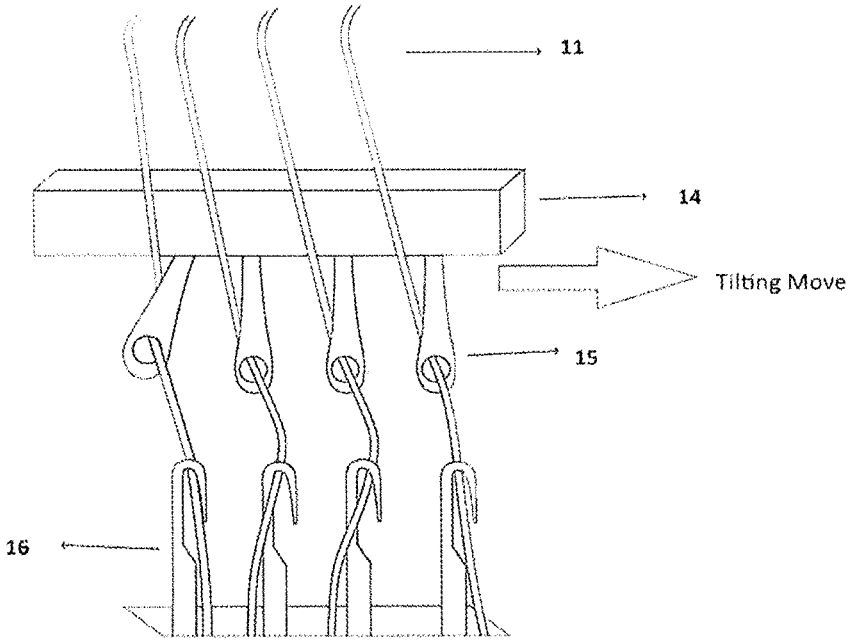
FIG. 5*a* is a schematic view of lower tilting movement.

FIG. 5*a* show lower tilting. The comb makes the so-called tilting movement. Because with this tilting, each perforated inlay needle (15) (together with the warp yarn (11)) makes a lateral movement (jump) behind the needle (16) (lower tilting).

Figure 5B:
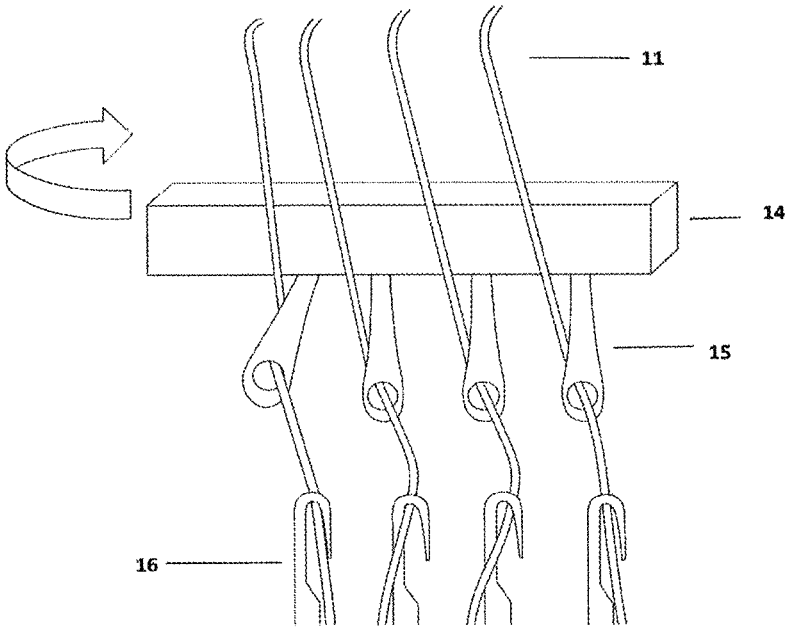
FIG. 5*b* is a schematic view inward oscillating movement.

FIG. 5*b* show inward oscillating movement. Perforated comb inlay needles (15) then make an inward oscillating movement between the two needles (16). The movements of the inlay needles (15) are guided by the inlay rail (14).

Figure 5C:
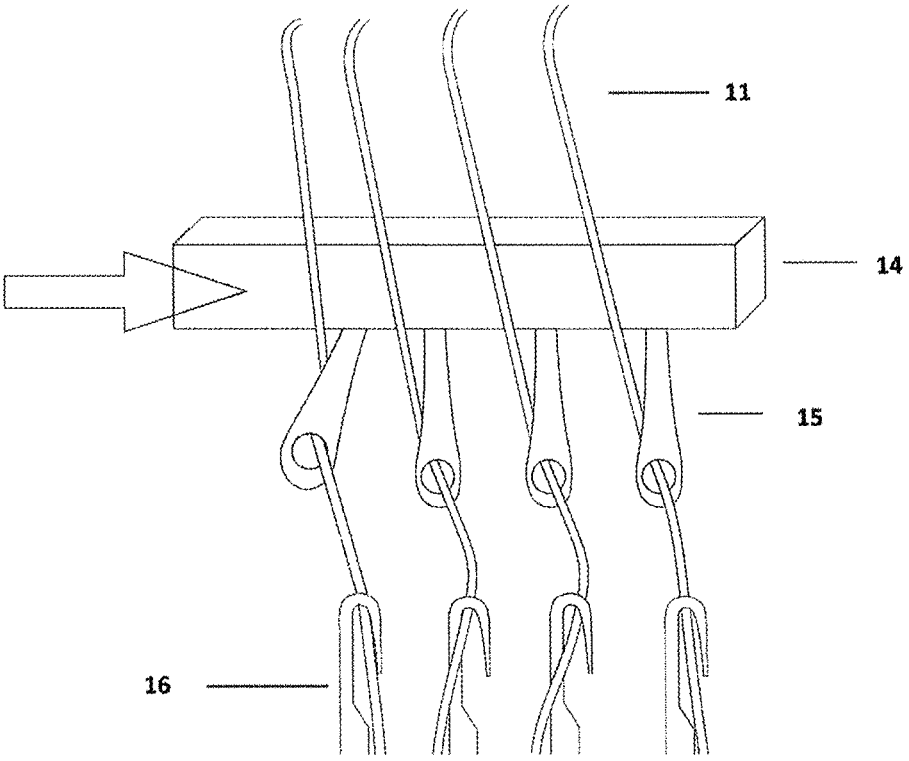
FIG. 5*c* is a schematic view of top tilting movement.
Figure 5D:
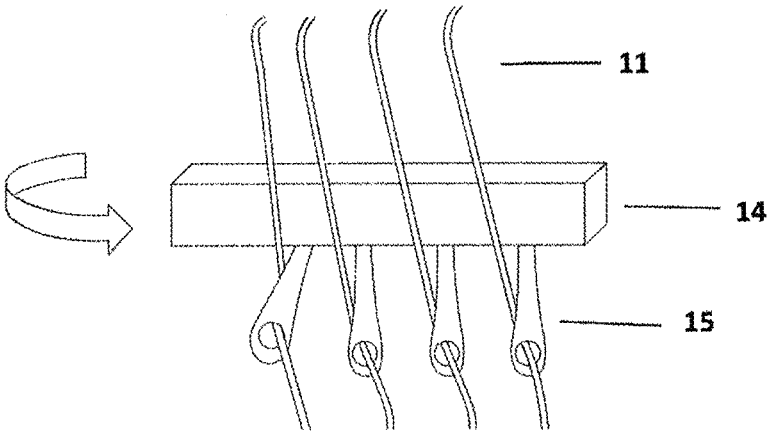
FIG. 5*d* is a schematic view outward oscillating movement.

FIG. 5*c* and FIG. 5*d* show the top tilting movement and outward oscillation movement, respectively. With the lateral movement, the warp yarns (11) are laid on the bodies of the needles (16) and the inlay needles passing between two neighboring needles (16) make an outward oscillation movement and the movement sequence is completed.

Figure 5E:
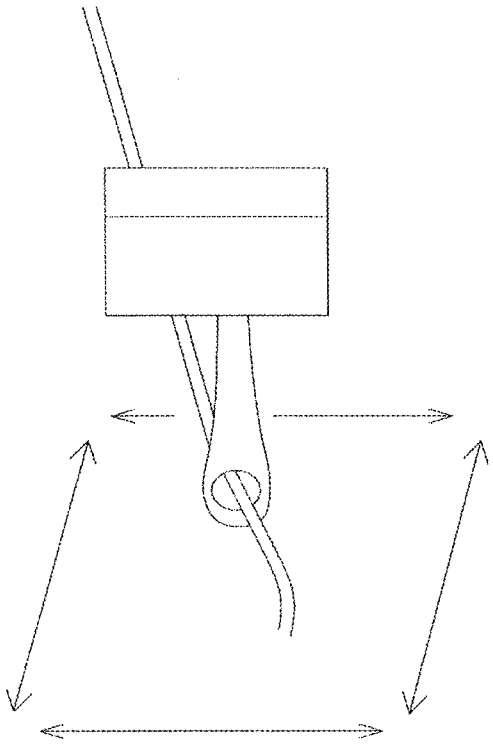
FIG. 5*e* shows movements of the inlay rail where the perforated inlay needle is located.

FIG. 5*e* show movements of the inlay rail (14) where the perforated inlay needle (15) is located.

With different variations, weft and pile yarns are used together with warp yarns in the same working principle. (FIG. 5, 5*a*-5*b*)

Warp yarns (beams), pile yarns (beams) and ground yarns (beams) provide the yarns for the warp knitting process. The yarns are fed into the needles via guide inlay needles (15). Together, the needles (16) are moved upward and downward. The supplied yarns are grasped by the needles (15) at its highest point during this action. The yarns are fed to the needles hooks by the guide needles (15), which swing around the needle (16).

Figure 6:
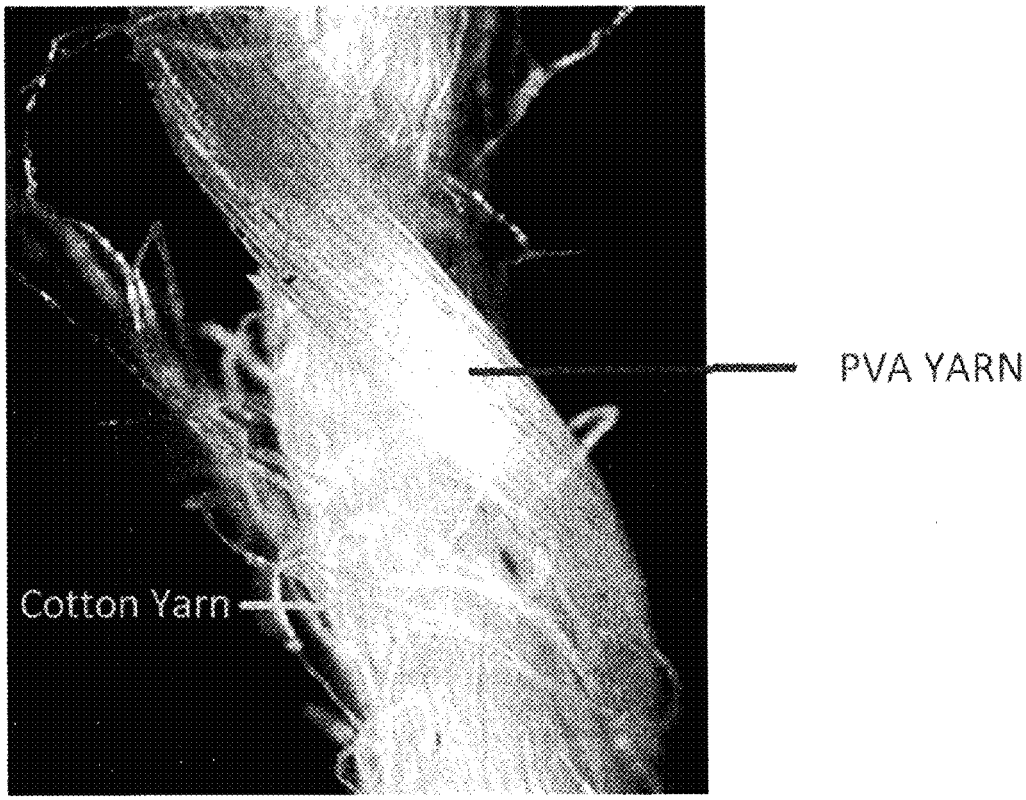
FIG. 6 illustrates the pile yarn (cotton yarn twisted with PVA yarn).

FIG. 6 shows the pile yarn (12) with increased strength. As can be seen, the pile yarn is formed by twisted a polyvinyl alcohol yarn and a cotton yarn having a thickness ranging from 120/1 Ne to 0.5 Ne.

Figure 7:
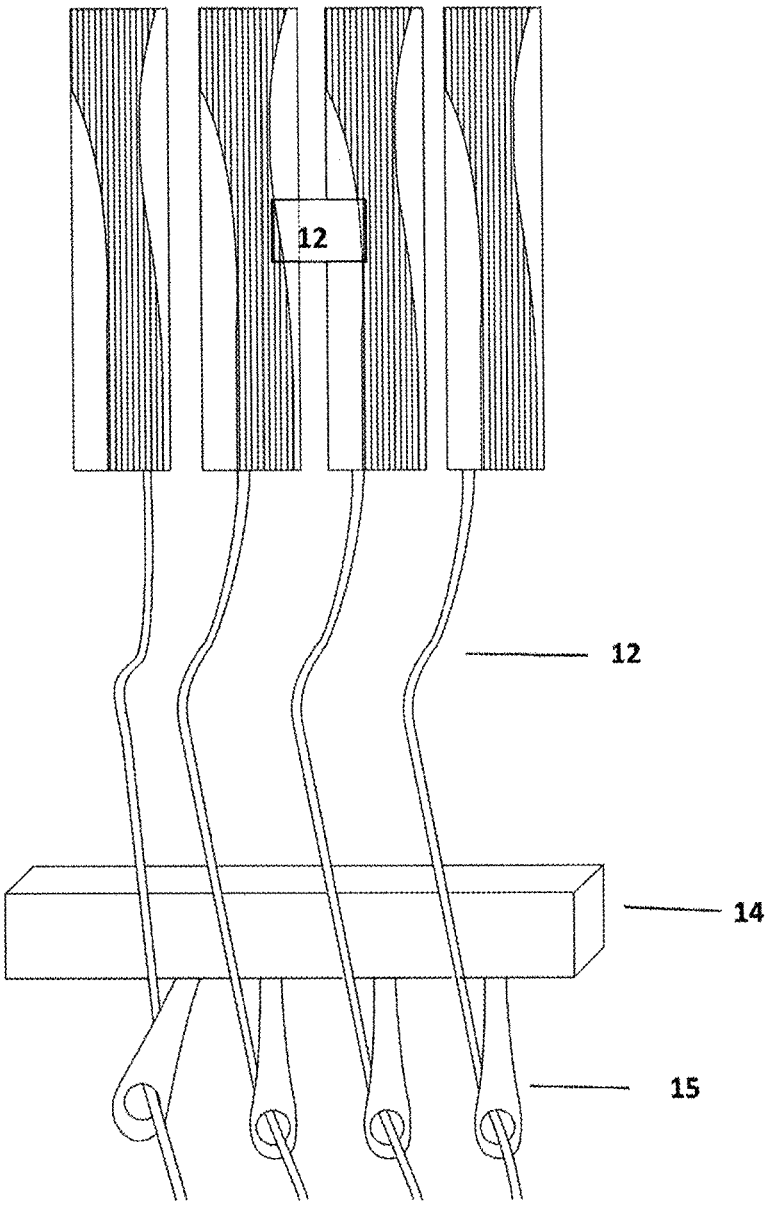
FIG. 7 illustrates the pile yarn's placement inside the inlay needles.
Figure 8:
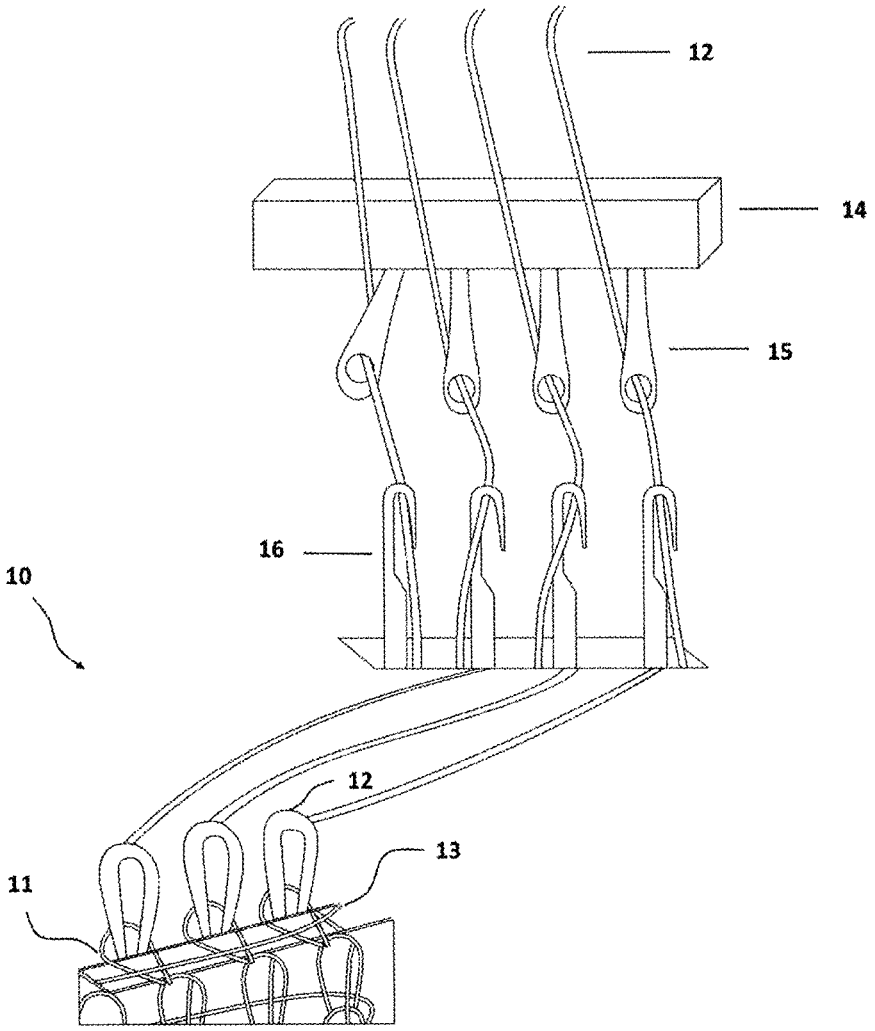
FIG. 8 illustrates the formation route in the system with pile yarn.

FIG. 7 and FIG. 8 shows Pile yarn (12) is placement inside the inlay needles. FIG. 8 shows the pile yarn (12), and the formation route in the system. The pile yarn (12) is formed by twisting a cotton yarn and the PVA yarn.

Figure 9:
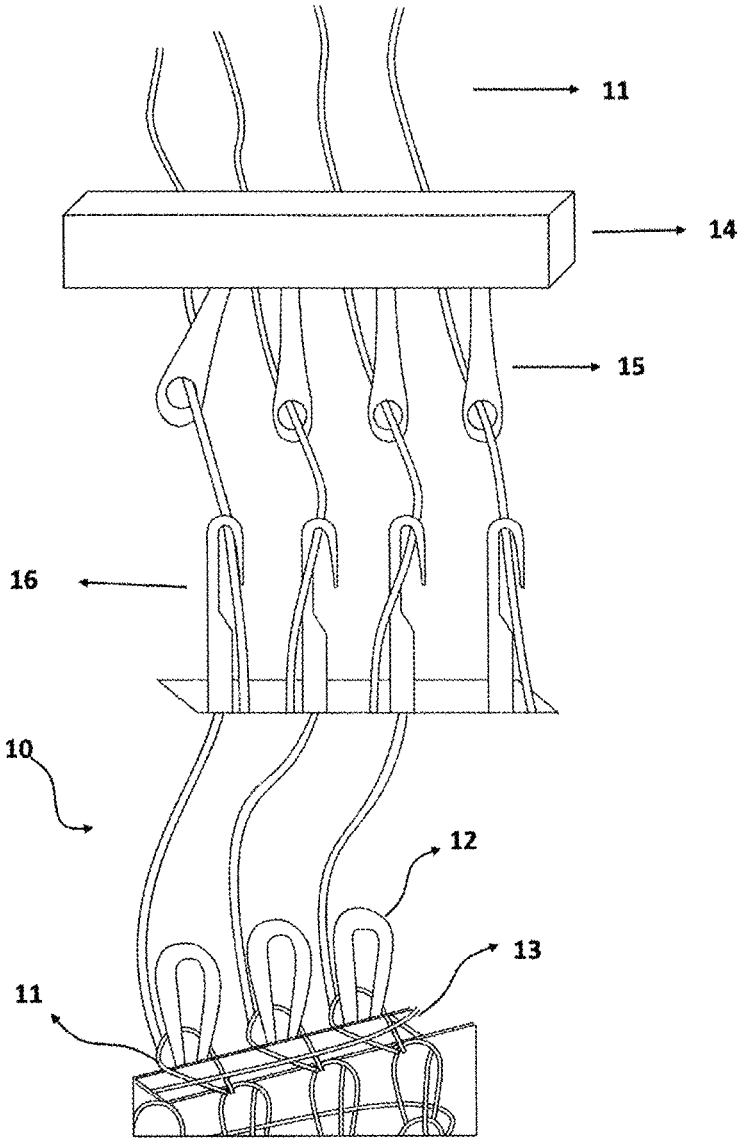
FIG. 9 illustrates the formation route in the system with warp yarn.

FIG. 9 shows the warp yarn (11), and the formation route in the system with the start of the warp yarn (11). As can be seen, warp yarn (11) is formed by twisting a first 80/1 Ne cotton yarn and a second 80/1 Ne cotton yarn. More than two first 80/1 Ne cotton yarns may be used to form the warp yarn (11).

Figure 10:
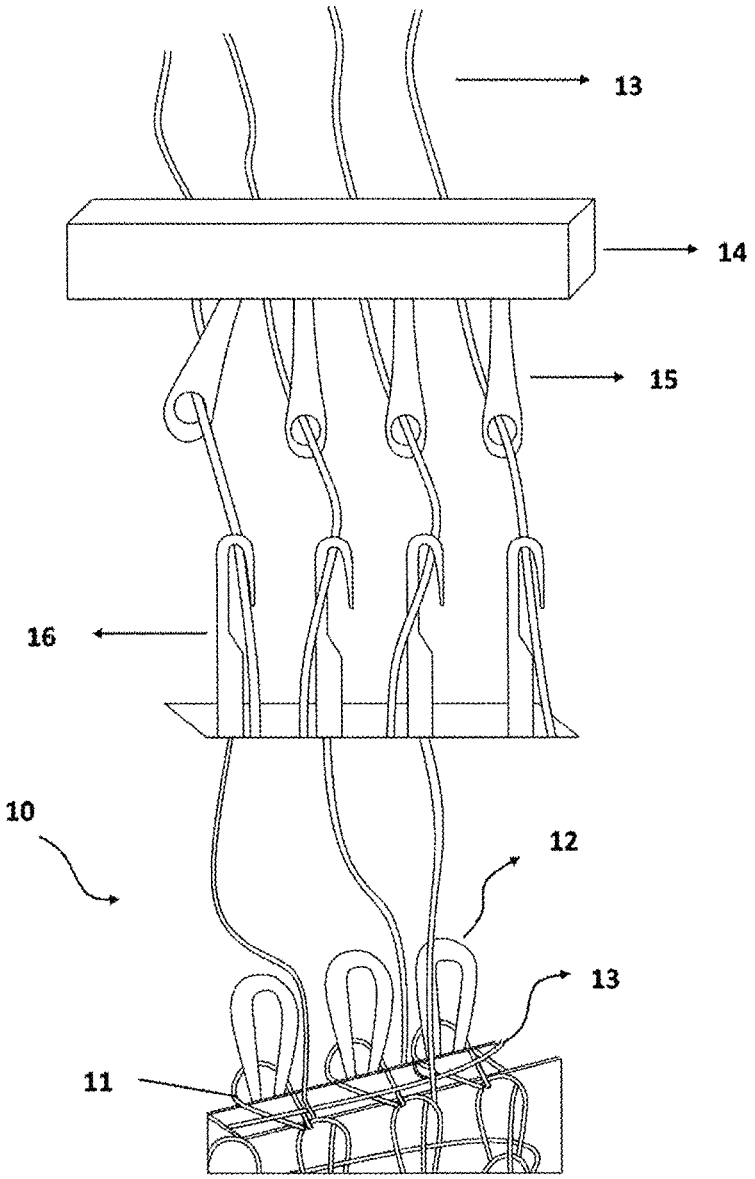
FIG. 10 illustrates the formation route in the system with ground yarn.

FIG. 10 shows the ground yarn (13) in the process to produce the final product. The ground yarn (13) is formed of 100% cotton by using double ply twisted cotton yarns, which is obtained by twisting two double ply twisted cotton yarns.

Figure 11:
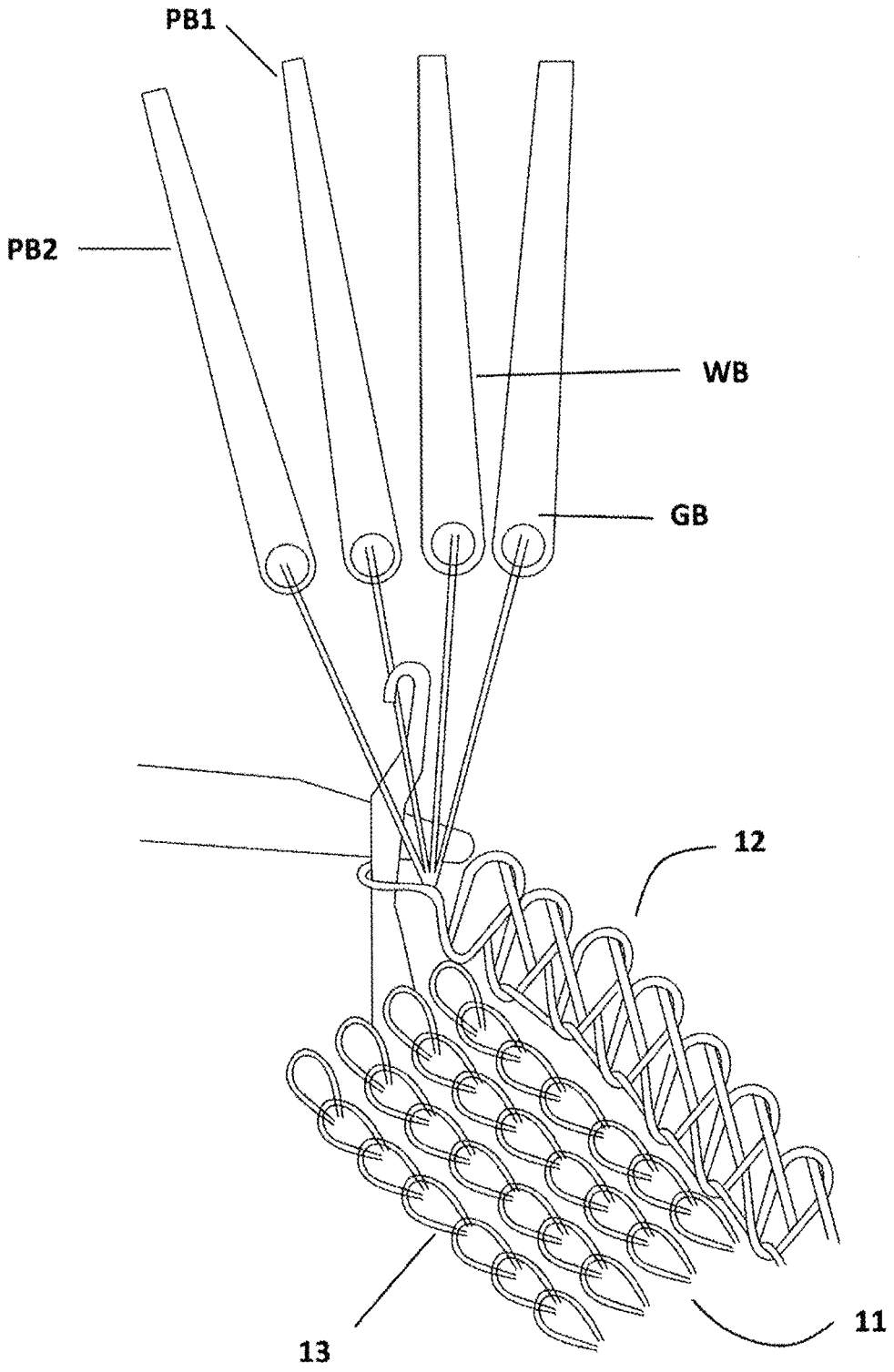
FIG. 11 is a schematic view of the method for producing a warp knit fabric.

FIG. 11 shows the WB (warp yarn 11) passing through the inlay needle is guided by the inlay rail bar movements. GB (ground yarn 13) passing through the inlay needle is guided by the inlay rail bar movements. PB 1 and PB 2 refer to pile yarn (12) through the inlay needle is guided by the inlay rail bars movements. GB and WB form the ground fabric and PB1 and PB2 also form the front and back piles.

The invention claimed is:

1. A method for producing a warp knit fabric from cotton yarns, the method comprising:

forming a warp yarn of 100% cotton by using a 80/2 Ne cotton yarn which is obtained by twisting two 80/1 Ne cotton yarns;

forming a pile yarn by twisting a polyvinyl alcohol yarn and a cotton yarn having a thickness of between 120/1 Ne to 0.5 Ne;

forming a ground yarn of 100% cotton by twisting two double ply twisted cotton yarns;

knitting the warp yarn and the pile yarn and the ground yarn in a warp knitting machine so as to form a warp knit fabric;

treating the warp knit fabric with an acid at 90° C. for twenty minutes; and removing the polyvinyl alcohol yarn from the treated warp knit fabric such that the warp knit fabric is 100% cotton.

2. The method of claim 1, wherein the step of knitting comprises:

decreasing a tension between a needle rail and an inlay rail of the warp knitting machine.

3. The method of claim 1, wherein the acid is acetic acid.

4. The method of claim 1, wherein the acid is formic acid.

* * * * *